US011427976B2

(12) United States Patent
Ustach et al.

(10) Patent No.: US 11,427,976 B2
(45) Date of Patent: Aug. 30, 2022

(54) BARRIER SYSTEM AND BARRIER SYSTEM INSTALLATION METHOD

(71) Applicant: McCue Corporation, Peabody, MA (US)

(72) Inventors: Thomas Ustach, Revere, MA (US); Fernando Fraga, Waltham, MA (US); Amanda Gene Meltzer, Boston, MA (US)

(73) Assignee: McCue Corporation, Peabody, MA (US)

( * ) Notice: Subject to any disclaimer, the term of this patent is extended or adjusted under 35 U.S.C. 154(b) by 0 days.

(21) Appl. No.: 17/201,873

(22) Filed: Mar. 15, 2021

(65) Prior Publication Data

US 2021/0207333 A1 Jul. 8, 2021

Related U.S. Application Data

(63) Continuation of application No. 17/258,886, filed as application No. PCT/US2019/042194 on Jul. 17, 2019.

(Continued)

(51) Int. Cl.
*E01F 9/65* (2016.01)
*E01F 15/00* (2006.01)

(Continued)

(52) U.S. Cl.
CPC ..... *E01F 9/658* (2016.02); *E01F 9/623* (2016.02); *E01F 15/003* (2013.01); *E01F 15/146* (2013.01)

(58) Field of Classification Search
CPC ... E01F 9/60; E01F 9/623; E01F 9/658; E01F 15/003; E01F 15/146
See application file for complete search history.

(56) References Cited

U.S. PATENT DOCUMENTS 833,202 A * 10/1906 Clough ..... E04H 12/2276 52/297
2,507,259 A * 5/1950 Levasseur ..... E02D 5/523 405/252

(Continued)

FOREIGN PATENT DOCUMENTS

CN 304495193 2/2018
CN 304554829 3/2018

(Continued)

OTHER PUBLICATIONS

Web forum link: cloudynights.com/topic/160141-rebarholding-it-in-placeany-tricks/ (Year: 2008).*

(Continued)

*Primary Examiner* — Abigail A Risic
(74) *Attorney, Agent, or Firm* — Morgan, Lewis & Bockius LLP

(57) ABSTRACT

Disclosed herein is a bollard system including an impact receiving post and a foundation cage. The impact receiving post includes an outer surface, a proximal end, and a distal end. The foundation cage defines a three-dimensional lattice structure. The foundation cage is coupled to the proximal end of the impact receiving post and is configured for installation in concrete beneath a ground surface. The foundation cage defines a recess to receive a proximal portion of the impact receiving post. The foundation cage includes a horizontal stop member at least partially extending across the recess and supporting the impact receiving post and preventing the impact receiving post from extending further into the foundation cage before the concrete sets.

30 Claims, 14 Drawing Sheets

Related U.S. Application Data

(60) Provisional application No. 62/732,780, filed on Sep. 18, 2018, provisional application No. 62/699,633, filed on Jul. 17, 2018.

(51) Int. Cl.

| | |
|---|---|
| ***E01F 15/14*** | (2006.01) |
| ***E01F 9/658*** | (2016.01) |
| ***E01F 9/623*** | (2016.01) |

(56) References Cited

U.S. PATENT DOCUMENTS

| | | | | |
|---|---|---|---|---|
| 3,141,655 | A * | 7/1964 | Platt | E01F 9/681 293/133 |
| 3,602,109 | A * | 8/1971 | Harrington | E01F 15/146 404/6 |
| 3,881,697 | A | 5/1975 | Glaesener | |
| 3,991,532 | A * | 11/1976 | Buxbom | E02D 27/42 52/297 |
| 4,290,585 | A | 9/1981 | Glaesener | |
| D268,084 | S | 3/1983 | Haggard | |
| 4,861,194 | A * | 8/1989 | Lang | B09B 1/00 405/129.55 |
| D316,459 | S | 4/1991 | Kira | |
| 5,090,348 | A | 2/1992 | Hugron | |
| 5,426,267 | A | 6/1995 | Underhill et al. | |
| 5,689,927 | A * | 11/1997 | Knight, Sr. | E01F 8/0023 181/210 |
| D400,278 | S | 10/1998 | Binsukor | |
| D426,012 | S | 5/2000 | Giese et al. | |
| D444,899 | S | 7/2001 | Bossy | |
| 6,340,790 | B1 * | 1/2002 | Gordin | E04H 12/2253 174/45 R |
| 6,345,930 | B1 | 2/2002 | Mohassel | |
| 6,398,392 | B2 * | 6/2002 | Gordin | E04H 12/2253 174/45 R |
| D477,682 | S | 7/2003 | Wang | |
| 7,240,464 | B2 * | 7/2007 | Oliphant | E04B 1/4121 248/218.4 |
| 7,699,558 | B2 * | 4/2010 | Adler | E01F 9/685 404/6 |
| 7,722,265 | B2 | 5/2010 | Schram et al. | |
| 7,775,738 | B2 * | 8/2010 | Darcy | E01F 13/12 404/6 |
| 7,850,391 | B2 * | 12/2010 | Omar | E01F 13/12 404/6 |
| D639,457 | S | 6/2011 | Naaman et al. | |
| 8,161,698 | B2 * | 4/2012 | Migliore | E02D 27/42 52/295 |
| 8,226,322 | B2 * | 7/2012 | Blair | E01F 13/123 404/11 |
| D667,332 | S | 9/2012 | Skalka | |
| 8,297,873 | B1 * | 10/2012 | Schram | E01F 9/685 404/9 |
| D821,009 | S | 6/2018 | Holmes | |
| D821,612 | S | 6/2018 | Lankford | |
| D829,363 | S | 9/2018 | Lan | |
| 10,309,073 | B1 * | 6/2019 | Beck | E02D 5/54 |
| 10,385,526 | B1 * | 8/2019 | Caval | E01F 13/12 |
| 10,648,187 | B2 * | 5/2020 | Phuly | E04H 12/341 |
| 10,689,868 | B2 * | 6/2020 | Saadatmanesh | E04C 3/30 |
| 2004/0265055 | A1 | 12/2004 | Zivkovic | |
| 2006/0140716 | A1 * | 6/2006 | Skalka | E04H 13/008 404/6 |
| 2007/0176159 | A1 | 8/2007 | Schram et al. | |
| 2008/0181721 | A1 | 7/2008 | Neusch | |
| 2009/0028638 | A1 * | 1/2009 | Crawford | E01F 13/12 404/6 |
| 2010/0172692 | A1 | 7/2010 | McCue et al. | |
| 2011/0033232 | A1 * | 2/2011 | Adler | E01F 13/12 404/6 |
| 2012/0090207 | A1 | 4/2012 | Johnston | |
| 2012/0195683 | A1 | 8/2012 | O'Connell | |
| 2015/0050084 | A1 | 2/2015 | Berto | |
| 2016/0053449 | A1 | 2/2016 | Kemper et al. | |
| 2016/0233818 | A1 | 8/2016 | Potter et al. | |
| 2017/0101750 | A1 | 4/2017 | Connell et al. | |
| 2017/0241088 | A1 | 8/2017 | Smith | |
| 2017/0314286 | A1 | 11/2017 | Bartels et al. | |
| 2019/0186092 | A1 * | 6/2019 | Neusch | E01F 13/12 |
| 2019/0276998 | A1 | 9/2019 | Caval | |
| 2020/0173421 | A1 * | 6/2020 | Garduno Estebanez | F03D 13/22 |
| 2020/0284055 | A1 * | 9/2020 | Saadatmanesh | E04C 3/34 |
| 2020/0378079 | A1 * | 12/2020 | Beason | E01F 13/00 |
| 2021/0115634 | A1 * | 4/2021 | Saadatmanesh | E01D 22/00 |

FOREIGN PATENT DOCUMENTS

| | | |
|---|---|---|
| CN | 306087288 | 10/2020 |
| JP | D1552853 | 6/2016 |
| JP | D1555332 | 8/2016 |
| JP | D1555427 | 8/2016 |
| KR | 10-0804094 B1 | 2/2008 |
| KR | 10-0804095 B1 | 2/2008 |
| KR | 100804095 B1 | 2/2008 |
| KR | 101060218 B1 | 8/2011 |
| KR | 300844022 | 3/2016 |
| KR | 300851791 | 4/2016 |
| KR | 1020190036801 A | 4/2019 |
| WO | D032086-002 | 4/1995 |
| WO | D032086-004 | 4/1995 |
| WO | D032086-005 | 4/1995 |
| WO | 2012059766 A1 | 5/2012 |
| WO | 2018231147 A1 | 12/2018 |
| WO | D208483-004 | 6/2020 |

OTHER PUBLICATIONS

International Search Report and Written Opinion dated Jan. 13, 2020 for International Patent Application No. PCT/US2019/042194, 16 pages.

International Search Report and Written Opinion dated May 24, 2021 for International Patent Application No. PCT/US2021/014351, 13 pages.

European Search Report issued in the corresponding European Patent Application No. 19837517, 2022; dated Mar. 14, 2022; 7 pages.

* cited by examiner

BARRIER SYSTEM AND BARRIER SYSTEM INSTALLATION METHOD

CROSS-REFERENCE TO RELATED APPLICATIONS

This application is a Continuation of U.S. patent application Ser. No. 17/258,886 filed Jan. 8, 2021, which is a U.S. National Phase of International Application No. PCT/US2019/042194 filed on Jul. 17, 2019, which claims the benefit of U.S. Provisional Patent Application No. 62/699,633 filed Jul. 17, 2018 entitled "Barrier System" and U.S. Provisional Patent Application No. 62/732,780 filed Sep. 18, 2018 entitled "Barrier System", each of which is incorporated by reference herein in its entirety.

FIELD OF THE INVENTION

This invention relates to barrier systems used to protect people and structures from collisions with vehicles, to control vehicle access to certain areas, to direct a flow of traffic, and/or to reduce damage to the vehicles that do contact the barrier system.

BRIEF SUMMARY OF THE INVENTION

In one embodiment, there is a barrier system including an impact receiving post having a solid cross section, the impact receiving post being bendable and having proximal end and distal end, and a foundation cage coupled to the proximal end and configured for installation beneath a ground surface.

The barrier system may include a damper coupled to the outer surface of the impact receiving post. The damper may extend at least partially along a length of the post. The damper may be comprised of an elastomeric material. In a further embodiment, the barrier system includes a cover that extends over the outer surface of the damper. The cover may comprise stainless steel. The foundation cage may comprise a plurality of members that cross one another to define a porous three dimensional structure. The foundation cage may define a recess that receives the impact receiving post and the foundation cage may include a platform at least partially extending across the recess to support the impact receiving post and prevent the impact receiving post from extending further into the foundation cage. The foundation cage may include a proximal end and a distal end, and the platform may be spaced apart from the proximal end and the distal end. The foundation cage may include one or more support members and the impact receiving post may extend through the support members. The foundation cage may include a beam which extends from a top of the foundation cage to a bottom of the foundation cage. The beam may extend from a first lateral side of the foundation cage to a second lateral side of the foundation cage, the second lateral side of the foundation cage opposite the first lateral side of the foundation cage. The beam may include a through-hole and the impact receiving post may extend through the through-hole. The beam may be oriented in line with an expected direction of impact. The impact absorbing post may include a flange, and the through hole may be adjacent a ridge that defines a pocket to receive the flange.

The barrier system may comply with at least one of ASTM F3016, ASTM F3016M, ASTM F2656, ASTM F2656M, PAS 68, and IWA 14. The impact receiving post may comprise a portion of a stainless steel rod stock. The impact receiving post may have a diameter of about 4 inches. The impact receiving post may have a height extending from the foundation cage of at least about 30 inches. The impact receiving post may have a diameter of about 4 inches and a height extending from the foundation cage of about 30 inches to about 54 inches. The foundation cage may overlap the impact receiving post by at least 21 inches. The foundation cage may have a diameter of about 6 inches. The foundation cage may have a height of about 36 inches and a diameter of about 6 inches.

The impact receiving post may be a solid steel post. The impact receiving post may be fabricated from steel having a tensile strength of at least 500 megapascals. The foundation cage may include an opening such that the impact receiving post is received in the opening in a predetermined orientation relative to the foundation cage.

The foundation cage and the impact receiving post may be configured to limit a displacement of the distal end of the impact receiving post to 48 inches or less when the barrier system is struck by a vehicle weighing up to 5,000 pounds and traveling at up to 10 mph. The footing and the impact receiving post may be configured to limit a displacement of the distal end of the impact receiving post to 48 inches or less when the barrier system is struck by a vehicle weighing up to 5,000 pounds and traveling at up to 20 mph.

In another embodiment, a barrier system comprises an impact receiving post having proximal end, a distal end, and a solid cross section, an elastomeric damper disposed on an outer surface of the impact receiving post, the elastomeric damper extending at least partially along a length of the impact receiving post, a cover disposed over an outer surface of the elastomeric damper, and a foundation cage including a plurality of members that cross one another to define a porous three dimensional structure, the foundation cage configured for installation in concrete beneath a ground surface and to receive the proximal end of the impact receiving post. The impact receiving post, the elastomeric damper and the cover may be configured to bend in response to being struck by a vehicle. The footing and the impact receiving post may limit displacement of the distal end of the steel impact receiving post to 48 inches or less when the barrier system is struck by a vehicle weighing up to 5,000 pounds and traveling at up to 30 mph.

In another embodiment, a barrier system comprises an impact receiving post having proximal end, a distal end, and a solid cross section, and a prefabricated foundation cage configured for installation in concrete beneath a surface and configured to receive the proximal end of the impact receiving post. When installed in the concrete, the s impact receiving post may be configured to meet or exceed at least one of ASTM F3016, ASTM F3016M, ASTM F2656, ASTM F2656M, PAS 68, and IWA 14 standards.

In another embodiment, a barrier system comprises a steel impact receiving post having a solid cross section, a proximal end, and a distal end, and a foundation cage coupled to the proximal end of the steel impact receiving post, the foundation cage having a diameter of about 4 inches to about 8 inches and a length below the steel impact receiving post of about 15 inches. The foundation cage may define a recess with a portion of the steel impact receiving post within the recess. The steel impact receiving post may have a diameter of 4 inches, a total length of about 40 inches to about 60 inches including a length above the foundation cage of about 34 inches to about 44 inches, and an overlap length where the steel impact post overlaps the foundation cage of about 16 inches to about 26 inches.

In another embodiment, a method of installing a barrier system includes digging a hole having a maximum diameter of 24 inches into a ground surface, inserting a first end of an impact receiving post having a solid cross section into a foundation cage, the impact receiving post having a diameter of 4 inches and a height of about 24 inches to about 48 inches, inserting the foundation cage and the impact receiving post into the hole, and inserting a substrate into the hole. The method may include core drilling an opening in a surface prior to the digging the hole. Core drilling may include drilling with a 12 inch drill bit. Digging the hole may include using a 10 inch auger. The method may include welding the foundation cage prior to inserting the foundation cage and the impact receiving post into the hole.

BRIEF DESCRIPTION OF THE SEVERAL VIEWS OF THE DRAWINGS

The foregoing summary, as well as the following detailed description of embodiments of the barrier system and barrier system installation method, will be better understood when read in conjunction with the appended drawings of exemplary embodiments. It should be understood, however, that the invention is not limited to the precise arrangements and instrumentalities shown. For example, although not expressly stated herein, features of one or more various disclosed embodiments may be incorporated into other of the disclosed embodiments.

In the drawings.

DETAILED DESCRIPTION OF THE EXEMPLARY EMBODIMENTS OF THE INVENTION

Figure 1:
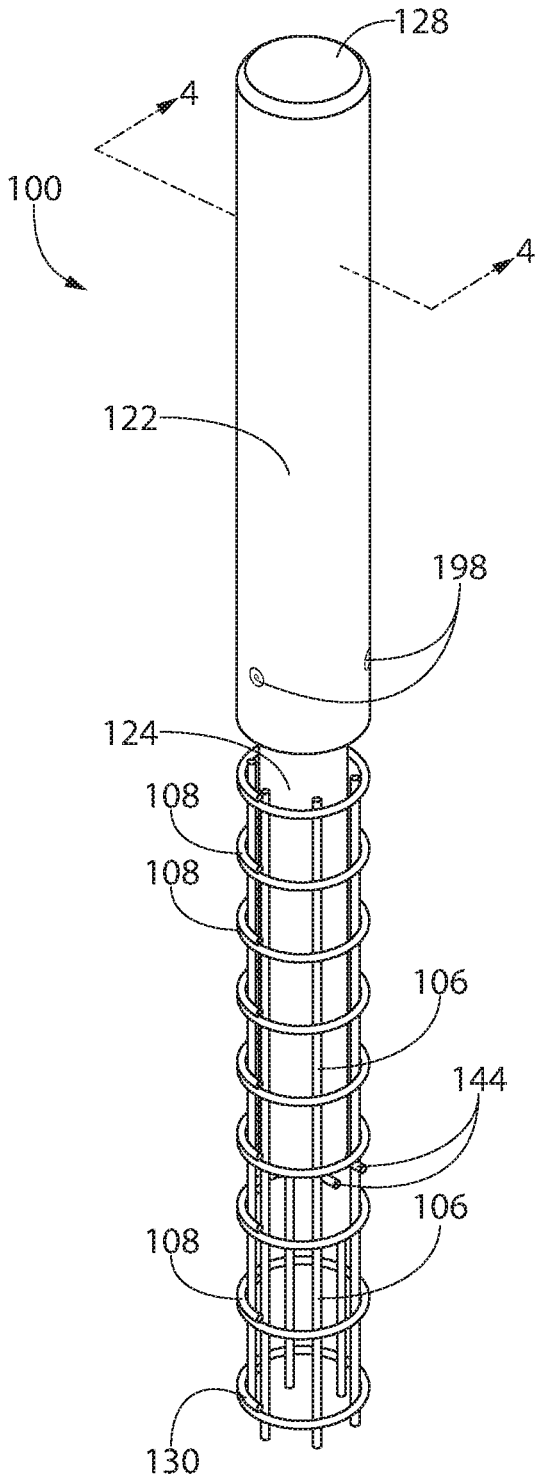
FIG. 1 a perspective view of a barrier system in accordance with an exemplary embodiment of the present invention.

Referring to FIGS. 1-8 wherein like reference numerals indicate like elements throughout, there is shown a barrier system, generally designated 100 in accordance with an exemplary embodiment of the present invention. The barrier system 100 may be configured to stop or hinder someone from driving a vehicle into an area. The barrier system 100 may protect a structure within the area (e.g., building), an area itself (e.g., outside dining tables), and/or an area occupied by pedestrians (e.g., a sidewalk). For example, the barrier system 100 may be useful to prevent egress of cars from a storefront where there is heavy foot traffic and otherwise unobstructed access to glass doors and windows. A series of barrier systems 100 may be used to create a vehicle barrier but allow for pedestrian traffic between the barrier systems 100. The barrier system 100 may include or also be referred to as a bollard.

Existing bollards may pull out of the ground partially or entirely, break, or shear off entirely upon impact with a vehicle allowing egress of the vehicle into the area intended to be vehicle free and/or causing the bollard or portions of the bollard to become a dangerous projectile. Because existing bollards are typically rigid structures, an impact with the bollard may also or alternatively result in unnecessary injury (e.g., avoidable air bag deployment) and/or damage to a vehicle. Damage to the vehicle and air bag deployment may be of particular concern in minor incidental impacts between a vehicle and a bollard (e.g., where a driver drives forward rather than in reverse when pulling out of a parking space in front of a building).

Existing bollards are typically hollow metal pipes filled with concrete. While such a bollard may give the impression of a secure barrier, such bollards have drawbacks. For one, concrete has low shear strength especially since the metal pipe is susceptible to corrosion. Also, typical barriers are often supported by too shallow or too massive of a footing resulting in the bollard ripping out of the ground upon impact or a reluctance by the property owner to replace the bollard after minor impacts with a vehicle due to the amount of concrete that would need to be replaced and the heavy machinery involved. Further, the underground footing reinforcement, if any, is typically manufactured on site and subject to assembly errors and oversights that are undetectable once installed and the underground portion is encased in concrete.

The barrier system 100 described herein is more resistant to corrosion and may undergo limited deflection when struck by an object to deflect and absorb some of the impact energy. The barrier system 100, in some embodiments, may also have further impact absorbing features such as covers and dampers and be easier to install and replace than traditional safety barrier systems as discussed in further detail below. The barrier system 100 may also have a pre-fabricated footing assembly that reliably retains the barrier system 100 in the ground while being easier to install and taking up a smaller footprint than traditional barrier systems.

Figure 2:
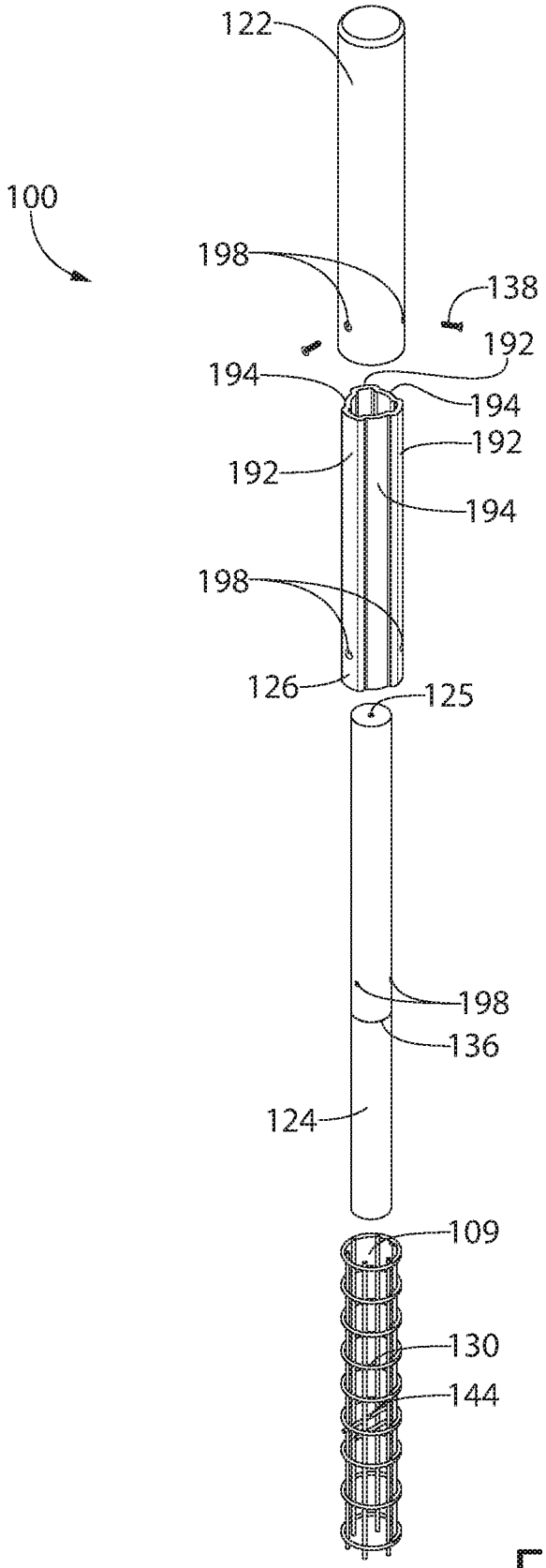
FIG. 2 is an exploded, perspective view of the post of FIG. 1.

Referring to FIGS. 1-2, the barrier system 100 includes a post 120. The post 120 may bend or deflect when impacted by a vehicle to deflect and absorb some of impact energy when struck by a vehicle as discussed in further detail below. The post 120 may be or may include a core 124. In some embodiments, the core 124 is a solid core (e.g., a core having a solid cross section). Existing hollow bollards may buckle when impacted by a vehicle. A core 124 having a solid cross section may resist buckling. A core 124 having a solid cross section may be resilient or bendable. The core 124 may be solid across at least a majority of its cross section such that there are no holes or gaps. For example, the core 124 may be cut from a stainless steel rod stock. In other embodiments, at least a portion of the core 124 is hollow (e.g., such as proximate the proximal end for attachment to the footing and/or proximate the distal end to accommodate sensors). In other embodiments, the core 124 has a substantially solid cross section (e.g., any central axially extending hole has a diameter that is less than about 50%, about 25%, or about 10% of the core diameter).

Figure 4:
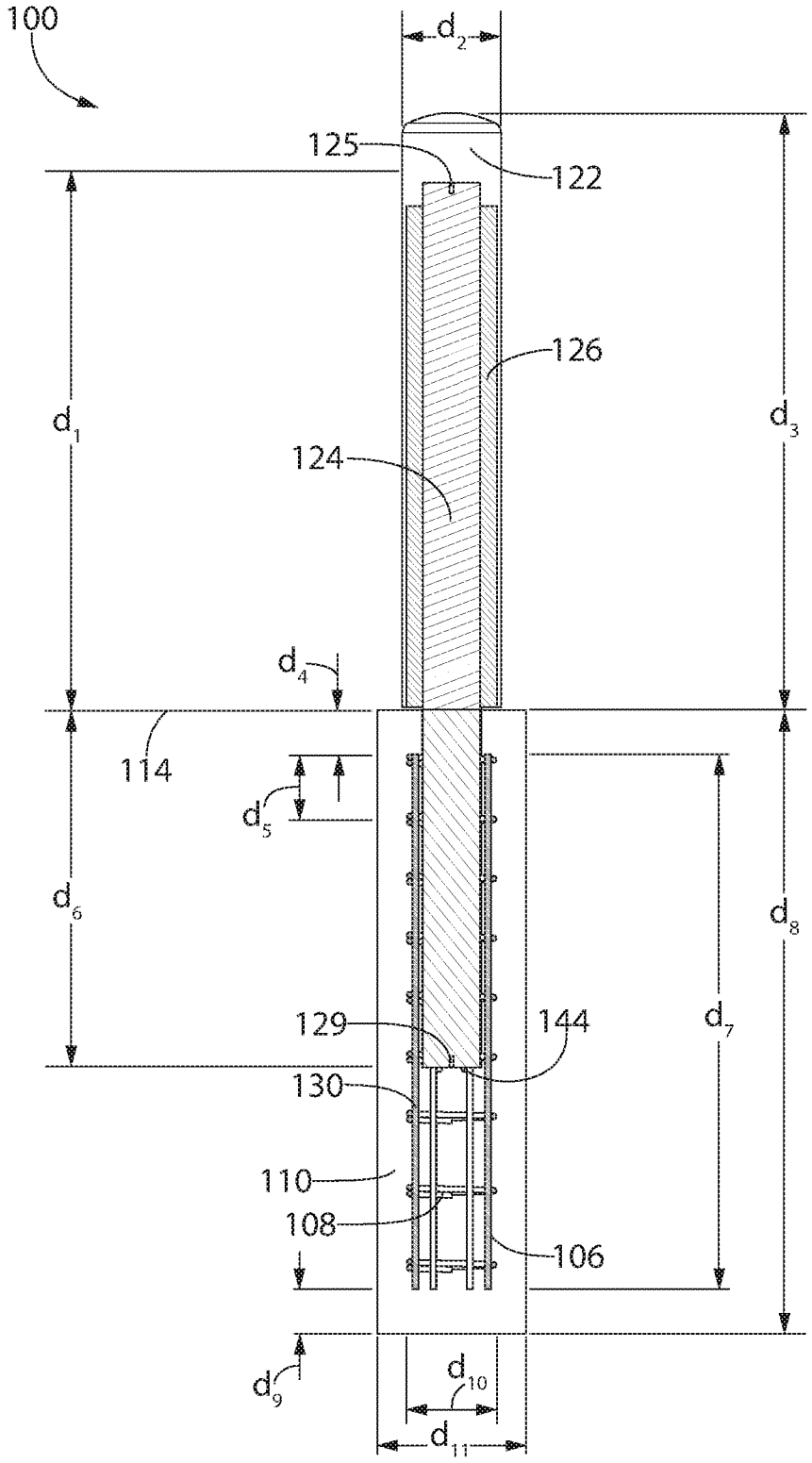
FIG. 4 is a cross-sectional side view of the barrier system of FIG. 1 taken along a plane including line 4-4 of FIG. 1.

Referring to FIGS. 2 and 4, the core 124 may be comprised of 4-inch diameter hot dipped galvanized steel rod stock that is cut to the desired length. In some embodiments, the desired length is about 60 inches. In some embodiment, the desired length is at least 60 inches. In other embodiments, the desired length may be about 90 inches, about 85 inches, about 80 inches, about 75 inches, about 70 inches, about 65 inches, about 60 inches, about 55 inches, about 50 inches, about 45 inches, or about 40 inches. In some embodiments, the rod stock is turned on a lathe to remove an outer layer of the core 124 (e.g., an outer layer having a thickness of about 1 millimeter). Removing an outer layer of the core may help with galvanizing the steel, to make the core 124 the desired diameter, and/or improve the appearance of the core 124, particularly for cores 124 that will be visible after installation. In some embodiments, the core 124 is galvanized after it is turned on the lathe. In other embodiments, the core 124 is galvanized after the core 124 is cut from rod stock.

The core 124 may be resilient such that the core 124 flexes to absorb some of the force of impact from a vehicle. The core 124 may be comprised of metal such as stainless steel (e.g., 316L stainless steel), 1045 hot rolled steel, 1045 polished steel, 1018 hot rolled steel, A36 steel, 12L14 steel, 1117 hot rolled steel, 1141 hot rolled steel, 1144 steel, or 4140 steel). The core 124 may be galvanized. By providing a solid core without concrete that extends from a secure base in the ground, the barrier system 100 is more corrosion resistant and configured to elastically bend or deflect when impacted by a vehicle, as described in greater detail below. The core 124 may be a continuous core that extends from below grade to above grade. The core 124 may include an indicator 136 configured to be positioned level with the grade when the core 124 is installed. The indicator 136 may provide an installer with a visual indication of the alignment of the core 124 relative to the ground surface. In some embodiments, the indicator 136 is a groove that is cut into the outer surface of the core 124 during the turning process. In other embodiments, the indicator 136 is painted or drawn on the core 124.

In some embodiments, the core 124 is cut from rod stock to a desired length. In one embodiment, the core 124 has a diameter of 4 inches. In other embodiments, the core 124 may have a diameter of about 10 inches, about 9 inches, about 8 inches, about 7 inches, about 6 inches, about 5 inches, about 4 inches, about 3 inches, about 2 inches, or about 1 inch. Holes (e.g., tap hole 125) or openings (e.g., opening 198) may be drilled in the core 124 after the core 124 is galvanized. A tap hole 125 may be positioned at each of the proximal end and the distal end of the core 124. The tap hole 125 may have a diameter of 0.5 inches with 13 threads per inch.

Referring to FIGS. 1-2, the barrier system 100 may include a cover 122 extending over the core 124. The cover 122 may include a recess to receive the core 124. The cover 122 may be closed on one end and open on the other end. The cover 122 may be fabricated from marine grade 316L stainless steel, mild steel, aluminum, iron, or a polymeric material. The cover 122 may be detachably coupled to the core 124. The cover 122 may include a light and the cover 122 may be detachably coupled to the core 124 to replace the light. The cover 122 may be replaceable after the barrier system 100 is installed. A replaceable cover 122 may eliminate the need to replace the entire barrier system 100 when the barrier system 100 is subjected to only a relatively small force of impact. The cover 122 may be moveable relative to the core 124 upon impact to allow for further absorption and deflection of the impact. For example, the cover 122 may reversibly bend radially inwardly toward the core to absorb minor impacts with the barrier system (e.g., a vehicle weighing up to 5,000 pounds traveling under 5 miles per hour). The post 120 may include the cover 122 and the core 124. A center of the cross section of the post 120 may be solid. A distal end of the barrier system 100 may be free and unattached once installed to for a cantilever structure.

It may be desirable for a barrier system to provide notification when a vehicle has collided with the barrier system. At least one of the cover 122 and the core 124 may include a sensor (not shown but could be an accelerometer, gyroscope, or force gauge). The sensor may be connected to a device configured to communicate with a user or an app (e.g., via a wired or wireless connection such as cellular, Bluetooth, WiFi or Zigbee communication protocols). The sensor may be configured to transfer information to a system and/or user to indicate that the barrier system has been impacted, the location of the barrier system, and the severity of the impact and automatically send an alert.

The cover 122 may also provide for a more customizable, replaceable, and professional appearance as compared to typical bollard that includes painted metal and concrete. In some embodiments, the cover 122 has a generally tubular shape. In other embodiments, the cover 122 is spherical. In still other embodiments, the cover 122 is rectangular or triangular. The cover 122 may have the shape of an object such as a light post, furniture (e.g., a bench), a garbage can, a person, an animal, a character, or a pawn shape. Multiple barrier systems 100 may be positioned adjacent each other to form a planter. Multiple barrier systems 100 may be positioned near each other and connected to each other to form a fence.

With a 4-inch core 124, the cover 122 may have a 6.75 inch outer diameter $d_2$. In other embodiments, the cover 122 may have an outer diameter $d_2$ of about 12 inches, about 11 inches, about 10 inches, about 9 inches, about 8 inches, about 7 inches, about 6 inches, about 5 inches, about 4 inches, about 3 inches, about 2 inches, or about 1 inch.

It may be desirable to couple an object to the barrier system 100. An upper end of the cover 122 may include an opening and a post (not shown but could be, for example, a 2.5 inch diameter post) may extend through the opening and couple to the core 124. A bracket (not shown) may couple to the core 124 via threaded engagement with the tap hole 125. A first end of the post may be coupled to the bracket and a second end of the post may be coupled to another object (e.g., a sign or a light).

Referring to FIG. 2, the barrier system 100 may include a damper 126. The damper 126 may be positioned between the core 124 and the cover 122. The damper 126 may absorb at least some energy when the barrier system 100 is impacted by a vehicle (e.g., a vehicle weighing up to 5,000 pounds traveling under 5 miles per hour). The damper 126 may be comprised of a resilient material such as rubber or elastomer (e.g., ethylene propylene diene terpolymer rubber). The damper 126 may at least partially return toward its original shape after the barrier system 100 is impacted by an external object. The damper 126 may couple to an outer surface of the core 124. The damper 126 may extend at least partially along a length of the core 124. The damper 126 may be fixed to the core 124 and the cover 122 may be detachably coupled to the damper 126 or core 124. The cover 122 may extend along an outer surface of the damper 126. In one embodiment, the cover 122 and the damper 126 extend along the majority of the length of the core 124 extending from a ground surface once installed. A vehicle may impact the cover 122 when the barrier system 100 is struck. The cover 122 may absorb some of the force of impact (e.g., by deforming) and also transfer some of the force of impact to the damper 126. The damper 126 may also absorb some of the force of impact and transfer some of the force of impact to the core 124.

Referring to FIG. 2, the damper 126 may have one or more outer surfaces 192. The outer surfaces 192 may be radially-spaced by interposed inner surfaces 194. A portion of the damper 126 may deform or displace into the spaces between the alternating inner surfaces 194 and outer surfaces when the barrier system 100 is impacted by a vehicle. The outer surfaces 192 may have a radius of curvature that matches the radius of the inside surface of the cover 122. The inner surfaces 194 may define an inner diameter that is greater than or equal to the outer diameter of the core 124. The alternating inner surfaces 194 and outer surfaces 192 of the damper 126 may ensure a tight fit against inner diameter of the cover 122 and a tight fit against the outer diameter of the core 124. The outer surfaces 192 may define the outer diameter of damper 126.

The damper 126 may be a unitary construct including the inner surfaces 194 and outer surfaces 192 such that the damper 126 is simultaneously in contact with and spaced from each of the cover 122 and the core 124 when the post 120 is assembled. The post 120 may be at least partially hollow. There may be a space between the outer surface 192 and the core 124 when the damper 126 is coupled to the core 124. There may be a space between the inner surface 194 and the cover 122 when the damper 126 is coupled to the core 124. The space between the damper 126 and the cover 122 may extend the longitudinal length of the damper 126. The space between the damper 126 and the core 124 may extend the longitudinal length of the damper 126. The post 120 may include a void defined by the spaces between the damper 126 and the cover 122 and the damper 126 and the core 124.

Figure 3:
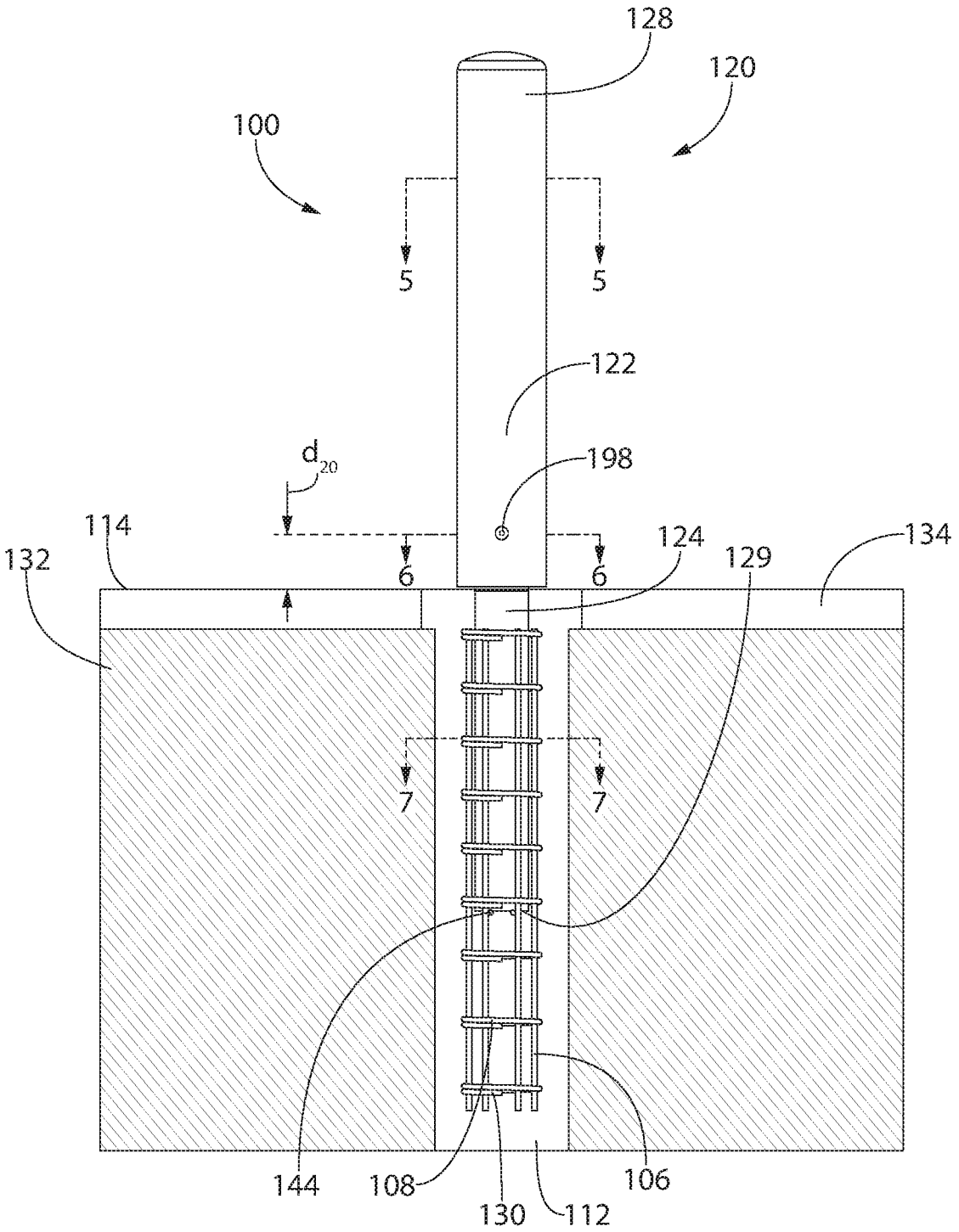
FIG. 3 is a front, elevational view of the barrier system of FIG. 1 installed in a substrate in the ground.
Figure 6:
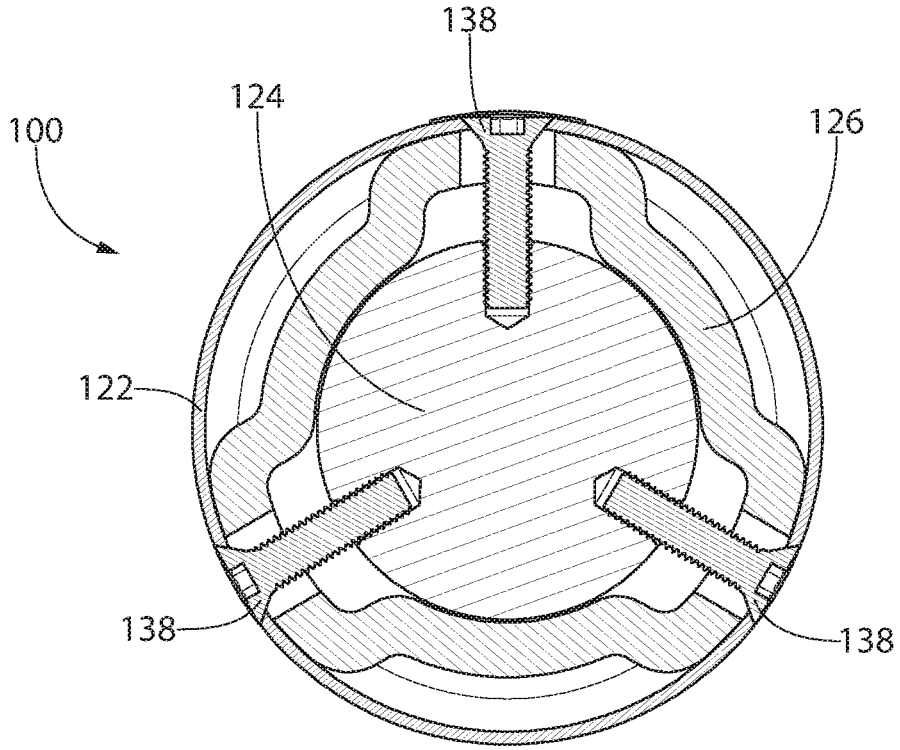
FIG. 6 is a cross-sectional top plan view of the barrier system of FIG. 1 taken along a plane including line 6-6 of FIG. 3.
Figure 7:
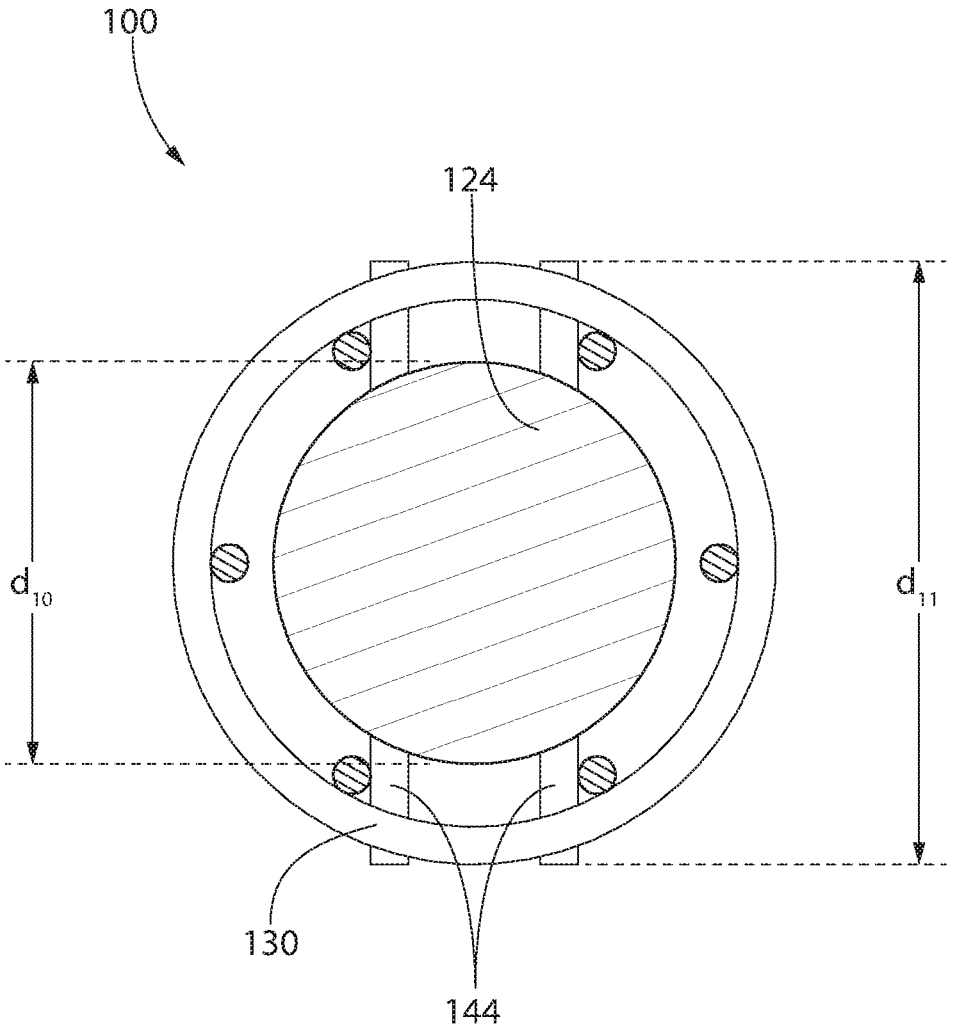
FIG. 7 is a cross-sectional top plan view of the barrier system of FIG. 1 taken along a plane including line 7-7 of FIG. 3.

It may be desirable to prevent the cover 122 from detaching from the post 120 and becoming a projectile when the barrier system 100 is impacted. Referring to FIGS. 2, 3, and 6, the core 124, damper 126, and cover 122 may be coupled to each other. In some embodiments, a fastener 138 (e.g., a threaded fastener, dowel, or pin) couples the core 124, damper 126, and cover 122 to each other. In some embodiments, the fastener 138 is removable to allow for replacement of the cover 122. In other embodiments, the fastener 138 is only removable with a specially keyed tool to prevent tampering. In still other embodiments, the fastener 138 is not removable from the barrier system 100 once assembled. In other embodiments, the core 124 damper 126 and cover 122 are coupled to each other via welding, adhesive, or interference fit.

Still referring to FIGS. 2, 3, and 6, the barrier system 100 may include an opening 198 to receive the fastener 138. In some embodiments, at least one opening 198 extends through the cover 122, the damper 126, and partially into the core 124. The opening 198 may be configured to receive the fastener 128, thereby coupling securing the core 124, damper 126 and cover 122 together. The opening 198 may be at a distance $d_{20}$ above the surface 114 of the ground. The distance $d_{20}$ may be about 2 inches, about 3 inches, about 4 inches or greater than about 4 inches. The opening 198 may be positioned above a portion of the core 124 that experiences a maximum bending force when impacted by a vehicle. In some embodiments, the portion of the core 124 between the ground surface 114 and about 4 inches above the ground surface 114 is the portion that experiences the most bending when impacted by a vehicle. In some embodiments, the barrier system 100 include three openings 198 and corresponding fasteners equally spaced from one another.

In some embodiments, the damper 126 and cover 122 provide a level of safety protection but the core 124 is configured to provide the majority of safety protection. In alternative embodiments, one or both of the damper 126 and cover 122 may be omitted entirely. In other embodiments, the damper 126 may be integral with the cover 122 or integral with the core 124. In alternative embodiments, the damper 126 may be coupled to the core 124 without the cover 122. The cover 122 may be sandwiched between two dampers 126. In some embodiments, the damper 126 or the cover 122 may extend over two or more cores 124. For example, the cover may include a cross members or a lattice structure that extends between two or more barrier system cores to limit pedestrian movement between the barrier systems while the cores themselves provide the majority of the vehicle protection.

Referring to FIGS. 3 and 4, the barrier system 100 may include a footing 110 that helps maintain the orientation of at least a lower portion of the barrier system 100 relative to the surface 114 (e.g., the ground). The footing 110 may include a foundation cage 130 and a substrate 112 (e.g., concrete, asphalt, cement, or stone). The footing 110 may be installed in a hole in the ground 132. The footing 110 may have a horizontal diameter $d_{11}$ of about 14 inches, about 12 inches, about 10 inches, about 8 inches, or about 6 inches. In some embodiments, the barrier system 100 may have a footprint that is about 90% smaller than the footprint of existing bollard systems. The substrate 112 may be concrete having a strength of about 2,000 pounds per square inch, about 2,500 pounds per square inch, about 3,000 pounds per square inch, about 3,500 pounds per square inch, about 4,000 pounds per square inch, about 4,500 pounds per square inch, or about 5,000 pounds per square inch.

Referring to FIG. 4, the barrier system 100 may extend above the surface 114 so drivers can see the barrier system 100 as well as to prevent egress of a vehicle. The distance $d_1$ that the core 124 extends above the surface 114 when installed may be about 54 inches, about 48 inches, about 44 inches, about 40 inches, about 36 inches, about 32 inches, or about 30 inches. The distance $d_6$ that the core 124 extends below the surface 114 may be about 32 inches, about 28 inches, about 24 inches, about 20 inches, or about 16 inches.

Referring to FIGS. 1, 3 and 4, the barrier system 100 is installed such that the proximal end of the barrier system extends into the ground. The barrier system 100 may include a foundation cage 130 to reinforce the distal end of the barrier system underground. The foundation cage 130 may define a recess 109 to receive the proximal end of the core 124. The foundation cage 130 may include a plurality of members that cross one another to define a three-dimensional lattice structure. The three-dimensional lattice structure may allow for concrete to be poured into and around the foundation cage 130 and for the concrete to flow vertically and horizontally through the foundation cage 130 such that the foundation cage 130 and the proximal end of the core 124 is fully encased in the concrete footing.

Still referring to FIGS. 1, 3, and 4, the foundation cage 130 may include one or more horizontal rods 108. In some embodiments, the horizontal rods 108 are spaced equidistant from each other. In other embodiments, the distance between the horizontal rods 108 varies. In some embodiments, the distance $d_5$ between at least two of the horizontal rods 108 at the top of the foundation cage 130 is less than the distance $d_9$ between at least two of the horizontal rods 108 at the bottom of the foundation cage. In other embodiments, there is more space between at least two of the horizontal rods 108 at the top of the foundation cage 130 than between at least two of the horizontal rods 108 at the bottom of the foundation cage. In one embodiment, distance $d_5$ or distance $d_9$ is about 6 inches, about 5 inches, about 4 inches, about 3 inches, about 2 inches, or about 1 inch. The top horizontal rod 108 may be positioned below the surface at a distance $d_4$ of about 6 inches, about 5 inches, about 4 inches, about 3 inches, about 2 inches, or about 1 inch. At least one horizontal rod 108 may define a platform 144 to support the core 124 when the core is inserted into an opening defined by the foundation cage 130.

Still referring to FIGS. 1, 3, and 4, the foundation cage 130 may include one or more vertical rods 106. The vertical rods 106 may be spaced equidistant from each other. The vertical rods 106 may extend the length of foundation cage 130. In some embodiments, at least one of the vertical rods 106 extends from the bottom of foundation cage 130 but does not extend completely to the top of foundation cage 130. At least two of the vertical rods 106 may be spaced at a distance of about 3 inches from each other.

The foundation cage 130 may be prefabricated or preconstructed. The foundation cage 130 may be prefabricated to a standard configuration to prevent variability between foundation cages 130 compared to traditional methods where rebar is bent and tied together on site. The foundation cage 130 may be prefabricated off site from the installation site. The foundation cage 130 may be welded before it is installed in a hole in the surface or before the foundation cage 130 is coupled to the post 120. The prefabricated foundation cage 130 and the post 120 may be commercially available as a kit. In some embodiments, the foundation cage 130 is fabricated by welding steel or iron pieces together. In other examples, the foundation cage 130 is formed as a single, integral part by casting iron or steel (e.g., using a sand casting procedure).

Figure 5:
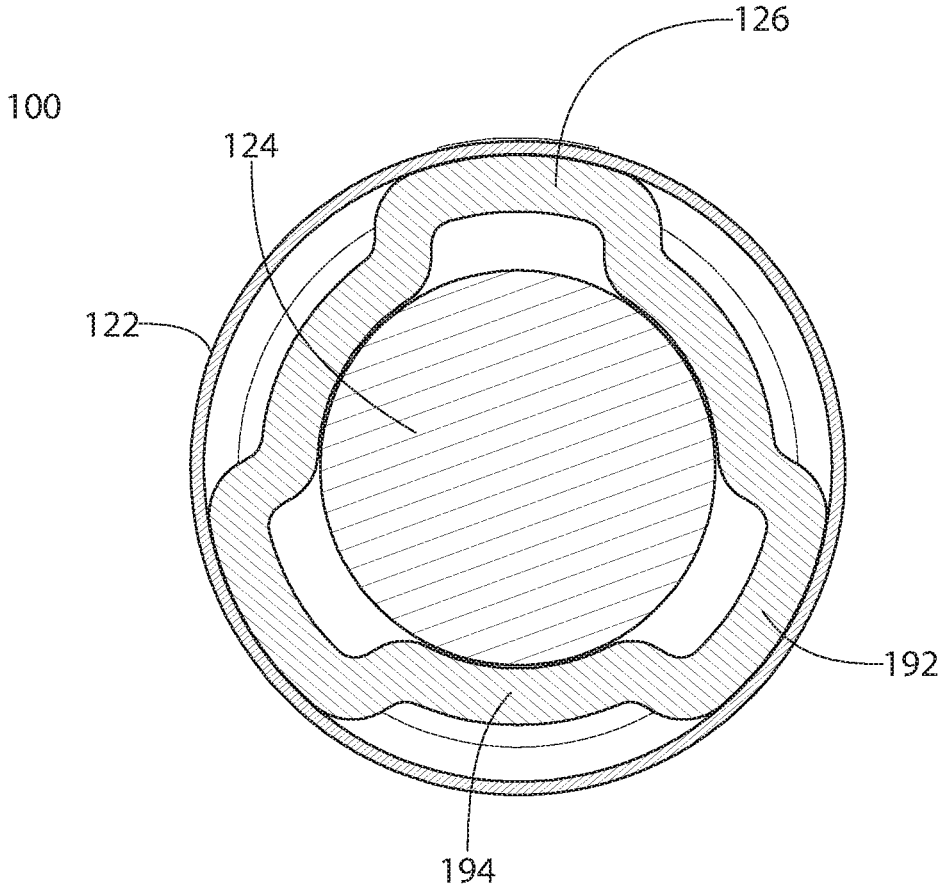
FIG. 5 is a cross-sectional top plan view of the barrier system of FIG. 1 taken along a plane including line 5-5 of FIG. 3.

Referring to FIGS. 4 and 5, foundation cage 130 may have a smaller top plan footprint than existing foundation cages. The foundation cage 130 may have a diameter of about 8 inches, about 7 inches, about 6 inches, about 5 inches, about 4 inches, or about 3 inches. The foundation cage 130 may have an inner diameter that is about 3 inches, about 2 inches, about 1 inch, about 0.5 inches, or about 0.25 inches larger than an outer diameter of the core 124. At least one of the horizontal rods 108 and vertical rods 106 may have a diameter of about 0.5 inches, about 0.4 inches, about 0.3 inches, or about 0.2 inches. The diameter of the core 124 may be smaller than the diameter of the foundation cage 130. The diameter of the foundation cage 130 may be smaller than the diameter of the cover 122.

Referring to FIG. 4, foundation cage 130 may have a larger vertical footprint than existing bollard systems. Foundation cage 130 may have a length $d_7$ of about 48 inches, about 44 inches, about 40 inches, about 36 inches, about 32 inches, about 28 inches, about 24 inches, or about 20 inches. The distance $d_8$ between the surface 114 and the bottom of the foundation cage 130 may be about 54 inches, about 50 inches, about 46 inches, about 42 inches, about 38 inches, about 34 inches, or about 30 inches. The distance $d_9$ between the bottom of the foundation cage 130 and the bottom of the footing 110 may be about 12 inches, about 11 inches, about 10 inches, about 9 inches, about 8 inches, about 7 inches, about 6 inches, about 5 inches, about 4 inches, about 3 inches, about 2 inches, or about 1 inch. The footing cage may have a height of about 36 inches and a diameter of about 6 inches.

In some embodiments, the core 124 is installed into the ground without the foundation cage 130. The core 124 may be installed at a depth of about 5 feet, about 3 feet, about 2 feet, or about 1 foot below grade when the core 124 is installed without the footing cage 130.

Referring to FIG. 3, the barrier system 100 may be placed in a hole in the surface 114 with the substrate 112. At least one of the cover 122 and the damper 126 may extend from the distal end 128 of the post 120 substantially to the surface 114. The damper 126 may be spaced from the distal end 128 of the core 124. A proximal end 129 of the core 124 may be within the foundation cage 130 and the substrate 112 when the barrier system 100 is installed.

Figure 8:
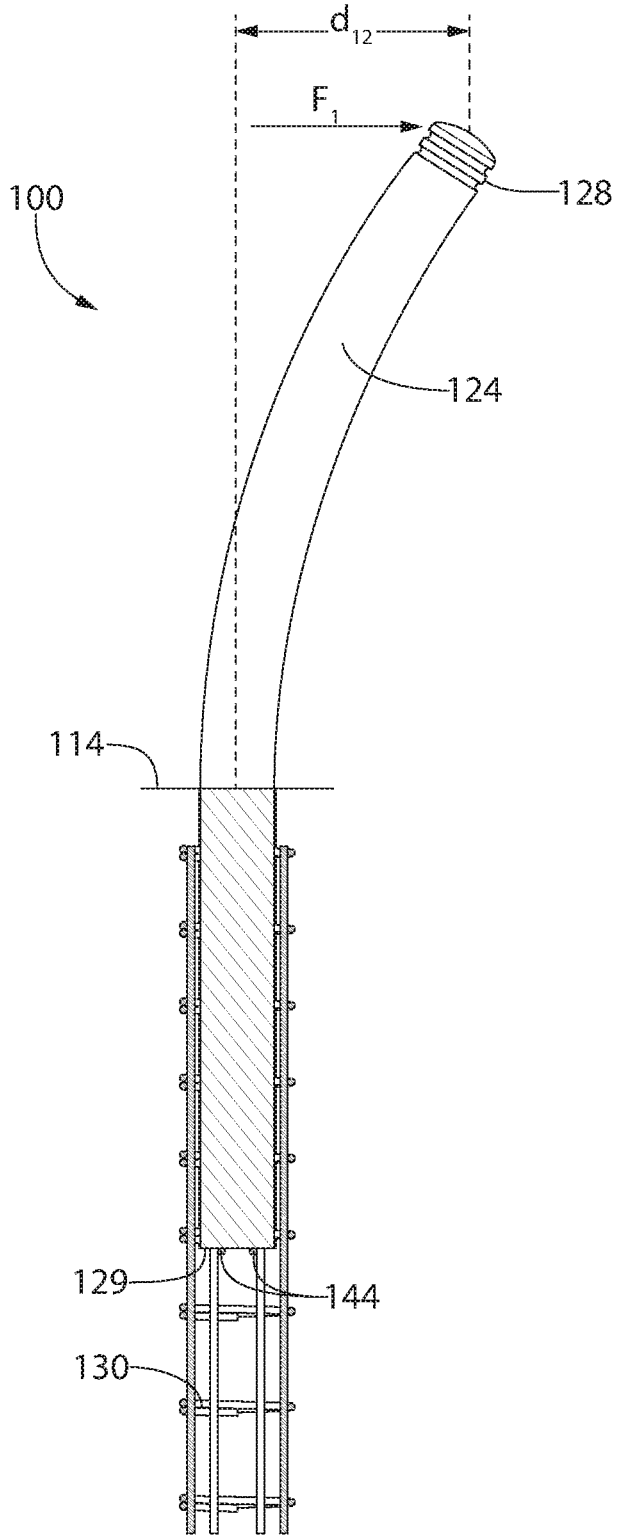
FIG. 8 is a side view of the barrier system of FIG. 1 in a deflected position.

Referring to FIG. 8, the barrier system 100 may be configured to bend along a portion of its length extending from the ground such that the distal end 128 of the post 120 deflects. In some embodiments, the cantilever bend of the post 120 acts to absorb and deflect energy from the vehicle to help to keep the post 120 intact, reduce damage to the vehicle and driver, and/or reduce air bag deployment. The bend of the post 120 and absorption and deflection of may also allow for a smaller footing, helping to make installation and replacement of the barrier system 100 easier.

Referring to FIGS. 3 and 8, in some embodiments, the post 120 may bend about a base of the post 120 (e.g., where the post 120 exits the surface 114) when the post 120 is impacted. In other embodiments, the deformation of the post 120 is distributed along the length of the post when the post is impacted. In some embodiments, the post 120 is permanently deformed when the post 120 is impacted. In other embodiments, the post 120 elastically deforms and returns to its original or close to its original shape after impact. The post 120 may undergo plastic deformation as a result of an impact.

Referring to FIG. 8, the distal end 128 the core 124 may deflect up to the maximum distance $d_{12}$ while the lower or proximal end 129 of the core 124 does not deflect because it is supported within foundation cage 130. A lateral impact force $F_1$ impinging upon post 120 is absorbed by the core 124 as well as the cover 122 and the damper 126 and foundation cage 130. The bending of the core 124 may help deflect some of the forces of impact. The core 124 may be resilient such that the core 124 elastically bends or deflects to absorb some of the force of impact when impacted by a vehicle. In some high impact situations, the vehicle may lift up as the vehicle extends past the original longitudinal centerline of the core 124 thereby dissipating some of the force of impact. That force is distributed through the foundation cage 130 and into the substrate 112 surrounding foundation cage 130. In other embodiments, the barrier system 100 does not include a cover 122 or damper 126 and the bend of the core 124 along with the footing 110 as disclosed herein are sufficient for the desired application (e.g., to satisfy the ASTM F3016 standard).

Referring to FIGS. 4 and 8, the barrier system 100 may include the foundation cage 130 that is about 5%, about 10%, about 15%, about 20%, about 25%, or about 30% larger than an outer diameter of the core 124 and a distal end 128 of the core 124 deflects a maximum distance $d_{12}$ of about 48 inches, about 45 inches, about 42 inches, about 39 inches, about 36 inches, about 33 inches, about 30 inches, about 27 inches, about 24 inches, about 21 inches, about 20 inches, about 19 inches, about 18 inches, about 17 inches, about 16 inches, about 15 inches, about 14 inches, about 13 inches, about 12 inches, about 11 inches, about 10 inches, about 9 inches, about 8 inches, about 7 inches, about 6 inches, about 5 inches, about 4 inches, about 3 inches, about 2 inches, or about 1 inch when the barrier system 100 is struck by a vehicle weighing 5,000 pounds traveling at 30 miles per hour.

The barrier system 100 may be configured such that the deflection distance $d_{12}$ of the distal end 128 of the post 120 deflects a distance that is in compliance with testing standards (e.g., ASTM F3016/F3016M-14, ASTM F2656/F2656M-18a, PAS 68, or IWA 14) standards. The barrier system 100 may exceed the minimum requirements for an ASTM F3016 rating. In some embodiments, the barrier system 100 exceeds the minimum requirements for the ASTM F3016 S20/S20/S30 and P1/P2 ratings. The deflection distance $d_{12}$ may be about 48 inches, about 47 inches, about 46 inches, about 45 inches, about 44 inches, about 43 inches, about 42 inches, about 41 inches, about 40 inches, about 39 inches, about 38 inches, about 37 inches, about 37 inches, about 36 inches, about 35 inches, about 34 inches, about 33 inches, about 32 inches, about 31 inches, about 30 inches, about 29 inches, about 28 inches, about 27 inches, about 26 inches, about 25 inches, about 24 inches, about 23 inches, about 22 inches, about 21 inches, about 20 inches, about 19 inches, about 18 inches, about 17 inches, about 16 inches, about 15 inches, about 14 inches, about 13 inches, about 12 inches, about 11 inches, about 10 inches, about 9 inches, about 8 inches, about 7 inches, about 6 inches, about 5 inches, about 4 inches, about 3 inches, about 2 inches, or about 1 inch when the barrier system 100 is struck by a vehicle weighing 5,000 pounds traveling at 30 miles per hour.

The deflection distance $d_{12}$ may be about 15 inches, about 14 inches, about 13 inches, about 12 inches, about 11 inches, about 10 inches, about 9 inches, about 8 inches, about 7 inches, about 6 inches, about 5 inches, about 4 inches, about 3 inches, about 2 inches, or about 1 inch when the barrier system 100 is struck by a vehicle weighing 5,000 pounds traveling at 20 miles per hour.

The deflection distance $d_{12}$ may be about 15 inches, about 14 inches, about 13 inches, about 12 inches, about 11 inches, about 10 inches, about 9 inches, about 8 inches, about 7 inches, about 6 inches, about 5 inches, about 4 inches, about 3 inches, about 2 inches, or about 1 inch when the barrier system 100 is struck by a vehicle weighing 5,000 pounds traveling at 10 miles per hour.

Referring to FIGS. 1-4, the barrier system 100 may be installed in less time or with less disturbance to the surrounding area (e.g., concrete 134) than existing bollard systems. The barrier system 100 may be installed in existing surfaces (e.g., sidewalks or parking lots) without the need to replace large patches of the surface. A method of installing the barrier system 100 may include core drilling an opening in the surface 114. The core drill may have a drill bit size of about 24 inches, about 22 inches, about 20 inches, about 18 inches, about 16 inches, about 14 inches, about 12 inches, about 10 inches, about 8 inches, about 6 inches, or about 4 inches. The method may include digging a hole (e.g., with an auger) in the ground 132. Installing the barrier system 100 with an auger may reduce installation time and avoid the use of heavy machinery. The auger may have a size of about 24 inches, about 22 inches, about 20 inches, about 18 inches, about 16 inches, about 14 inches, about 12 inches, about 10 inches, about 8 inches, about 6 inches, or about 4 inches.

The method may include positioning the core 124 within the recess 109 defined by the foundation cage 130. The core 124 and the foundation cage 130 may be placed in the hole. The method may include pouring in the substrate 112 (e.g., concrete having a strength of about 2,000 pounds per square inch to about 4,000 pounds per square inch). In some embodiments, an eye bolt (not shown) or other attachment is threaded into the tap hole 125 and the core 124 is picked up by the eye bolt (e.g., using a hoist, forklift, or backhoe). Gravity may bias the core 124 toward being plumb when the core 124 is picked up the eye bolt. In other embodiments, the core 124 is checked for plumbness and adjusted (e.g., manually) as necessary to ensure the core 124 remains plumb as the substrate 112 is added. The damper 126 and the cover 122 may be coupled to the core 124. The fastener 138 may be positioned in the opening 198 in each of the core 124, damper 126, and cover 122.

Figure 9:
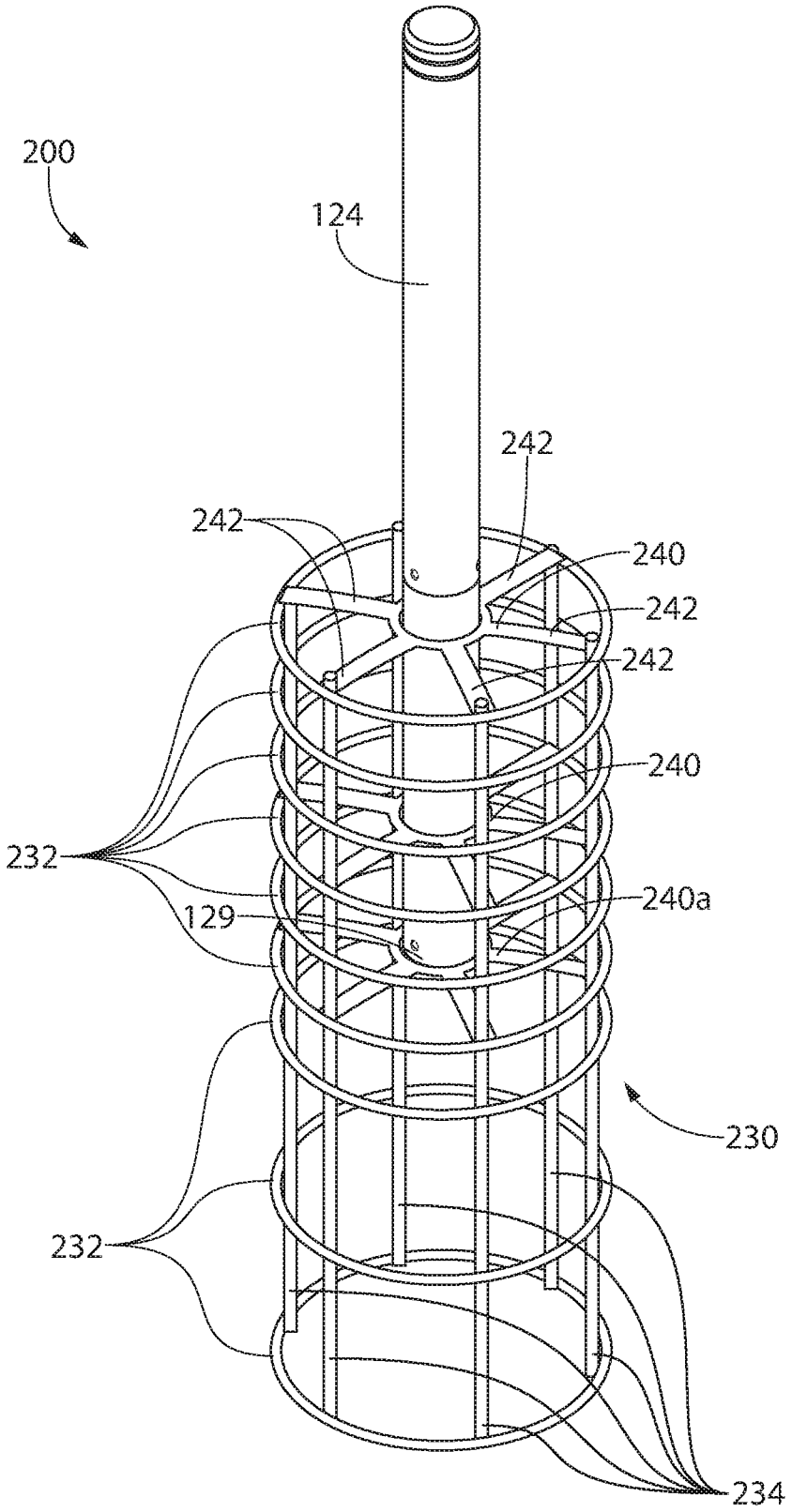
FIG. 9 is a perspective view of a barrier system in accordance with another exemplary embodiment of the present invention.
Figure 10:
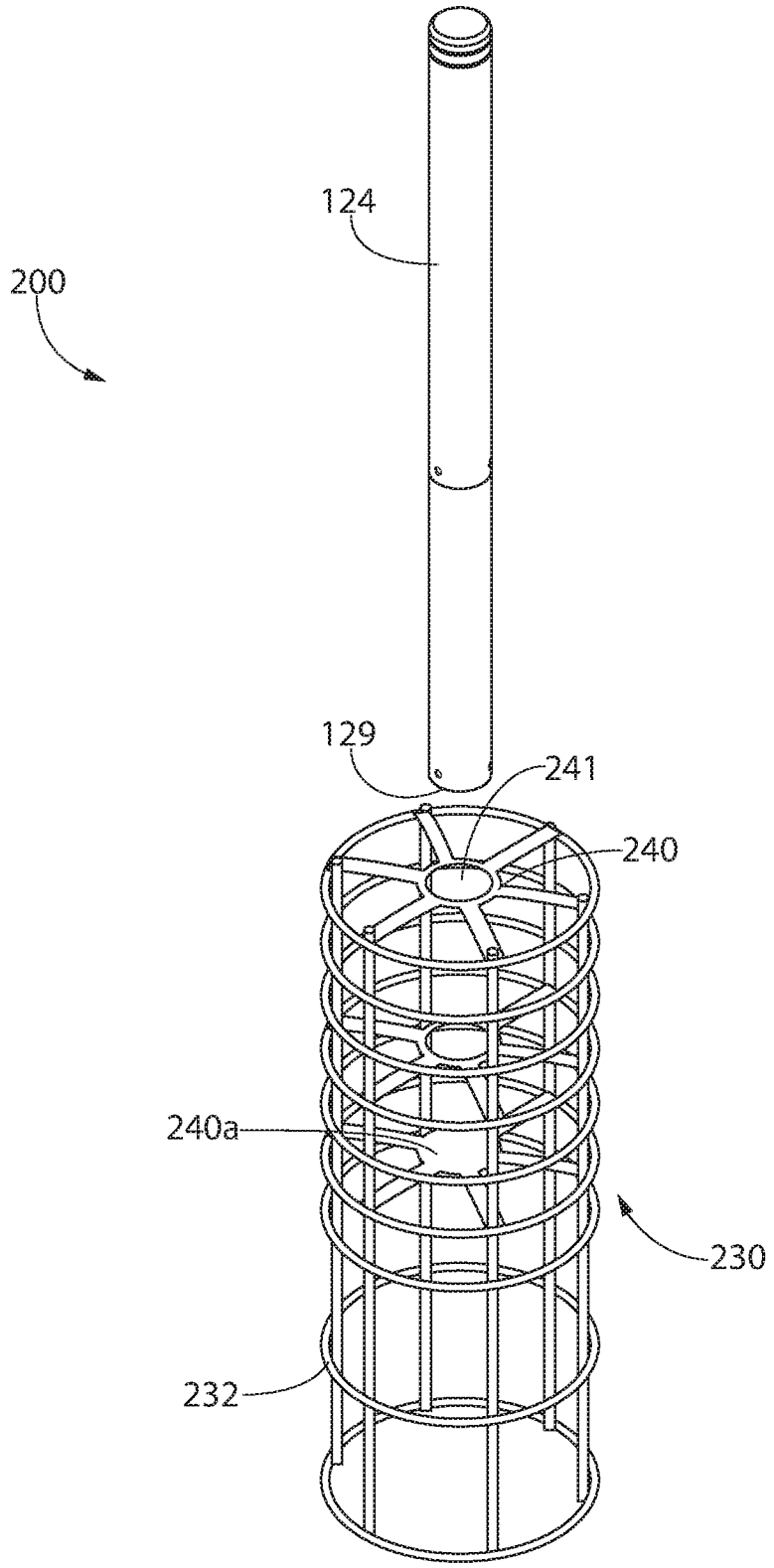
FIG. 10 is an exploded view of the barrier system of FIG. 9.

Referring to FIGS. 9-10, there is shown another embodiment of the barrier system, generally designated 200. The barrier system 200 is similar to the barrier system 100 except that the foundation cage 230 is different from foundation cage 130. The foundation cage 230 may be of a desired shaped (e.g., cylindrical or rectangular) and formed by a series of spaced rings 232. The rings 232 may be horizontal. In some embodiments, the rings 232 are circular. In other embodiments, the rings 232 have an arcuate shape but do not form a complete circle. In still other embodiments, the rings 232 have a shape other than circular (e.g., rectangular). The rings 232 within an upper portion 236 of the foundation cage 230 may be closely spaced than rings 232 within a lower portion 238 of the foundation cage.

Still referring to FIGS. 9-10, the rings 232 may be longitudinally spaced from each other. The rings 232 may be coupled to one or more rods 234. The rods 234 may extend longitudinally. The rods 234 may be circumferentially spaced.

Still referring to FIGS. 9-10, the barrier system 200 may include one or more support members 240. The support member 240 may include spokes 242 extending radially outwardly from a hub. The spokes 242 may be coupled to the rings 232. The support member 240 may include an opening 241 (FIG. 10) to receive the core 124. At least one support member 240 (e.g., the lowest support member 240*a*) does not include an opening 241 such that the support member 240 serves as a platform that supports the proximal end 129 of core 124. The rods 234, rings 240, and support members 240 may be formed of a relatively rigid and high-strength material (e.g., steel).

The deflection distance $d_{12}$ of the core 124 may be similar or the same when either of foundation cage 130 and foundation cage 230 are utilized with the post 120. However, foundation cage 130 may have a smaller horizontal area footprint. Either of foundation cage 130 and foundation cage 230 may be prefabricated or pre-constructed. The post 120 and either of foundation cage 130 and foundation cage 230 may be commercially available as a kit. In some embodiments, the foundation cage either of foundation cage 130 and foundation cage 230 is fabricated by welding steel or iron pieces together. In other examples, either of foundation cage 130 and foundation cage 230 is formed as a single, integral part by casting iron or steel (e.g., using a sand casting procedure).

In certain applications, it may be preferable to have a barrier system that utilizes a shallow footing. Referring to FIGS. 11-14, there is shown another embodiment of the barrier system, generally designated 300. The barrier system 300 is similar to barrier system 100 except that the foundation cage 330 is different from foundation cage 130. The barrier system 300 includes a post 320 and foundation cage 300. Similarly to barrier system 100 and barrier system 200, the barrier system 300 is configured such that a deflection distance $d_{12}$ of a distal end 128 of the post 320 does not exceed a maximum deflection distance when the barrier system 300 is struck by a vehicle with a predetermined weight traveling at a predetermined speed.

Figure 13:
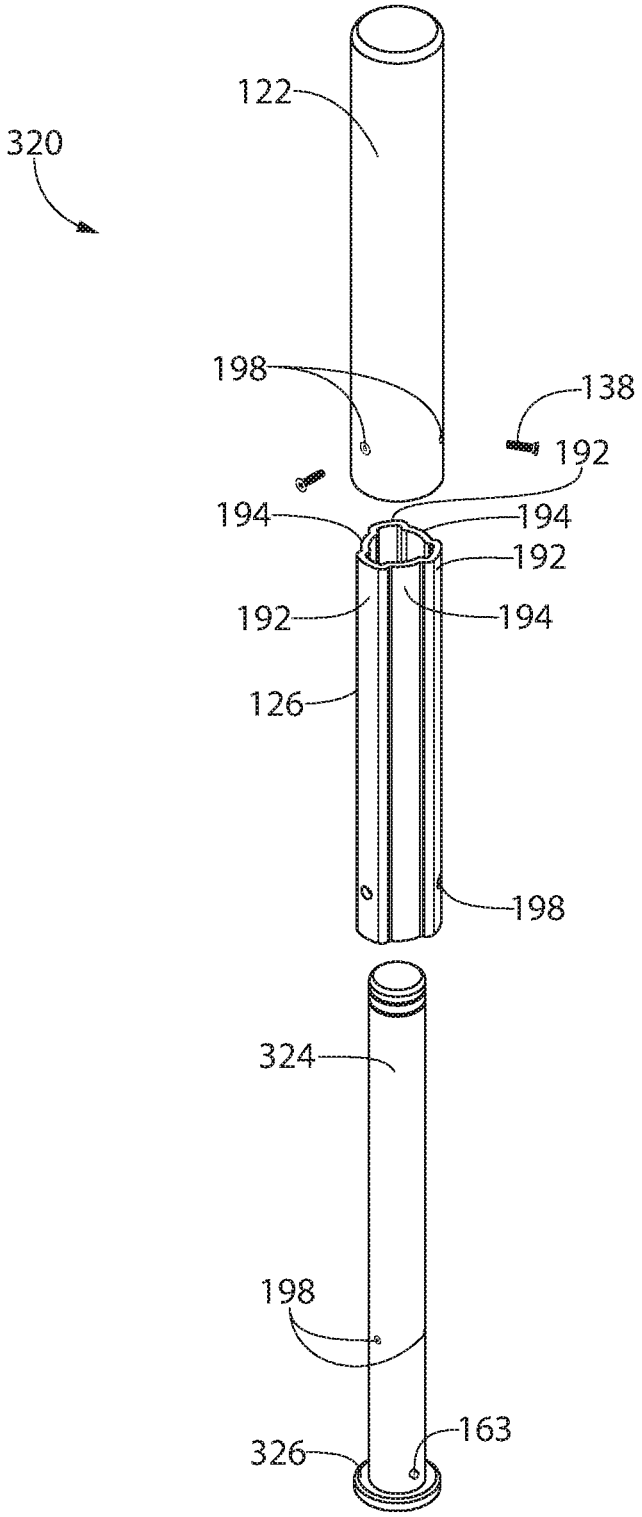
FIG. 13 is an exploded view of the barrier system of FIG. 11 with a cover and damper.
Figure 14:
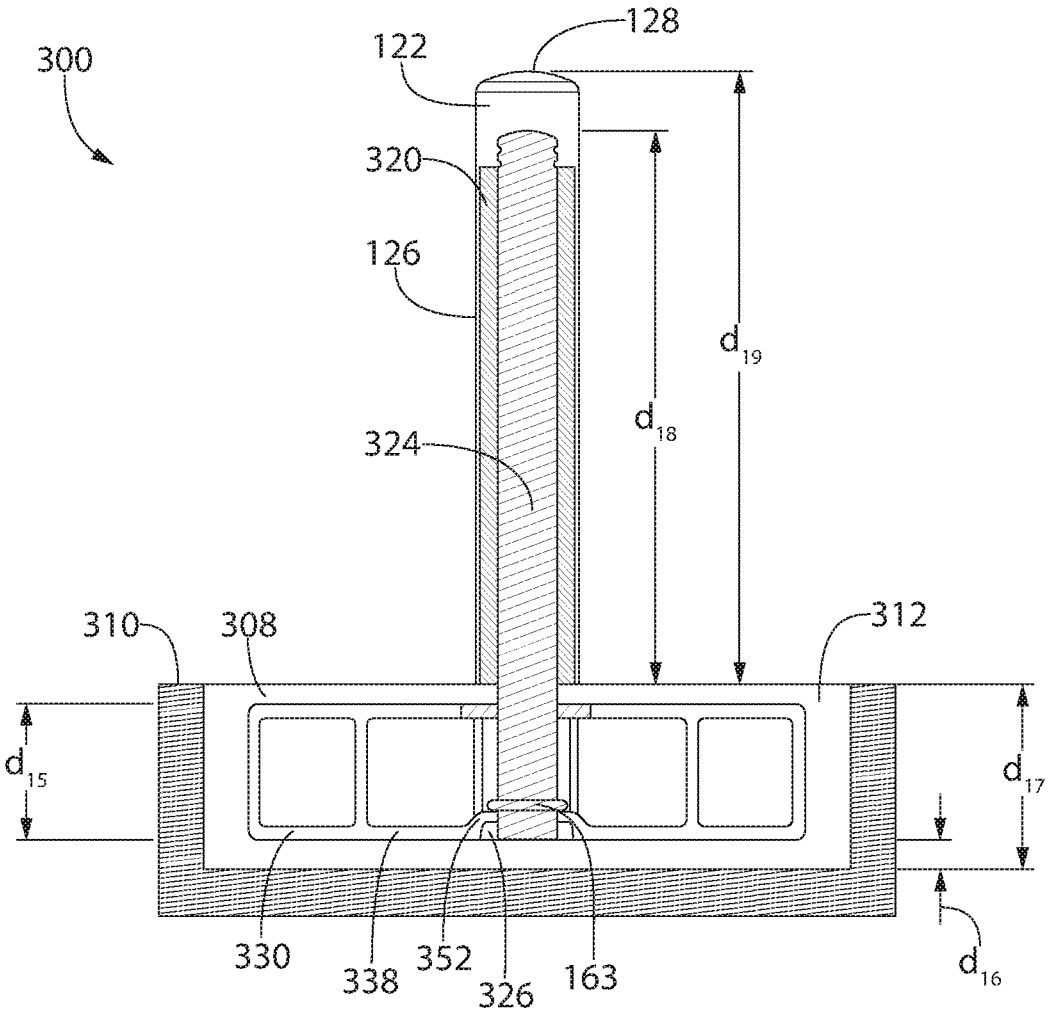
FIG. 14 is a cross-sectional side view of the barrier system of FIG. 11 taken along a plane including line 14-14.

Referring to FIGS. 13-14, the post 320 may include cover 122, damper 126, and a core 324. The cover 122 and the damper 126 may extend from the distal end 128 of the post 320 toward the surface 310. A proximal end 329 of the core 324 may extend within the substrate 308 the foundation cage 330. The core 124 may include a hole 197 configured to receive a fastener 163 (e.g., a threaded fastener, dowel, or pin). The fastener 163 may couple the core 324 to the foundation cage 330.

Figure 11:
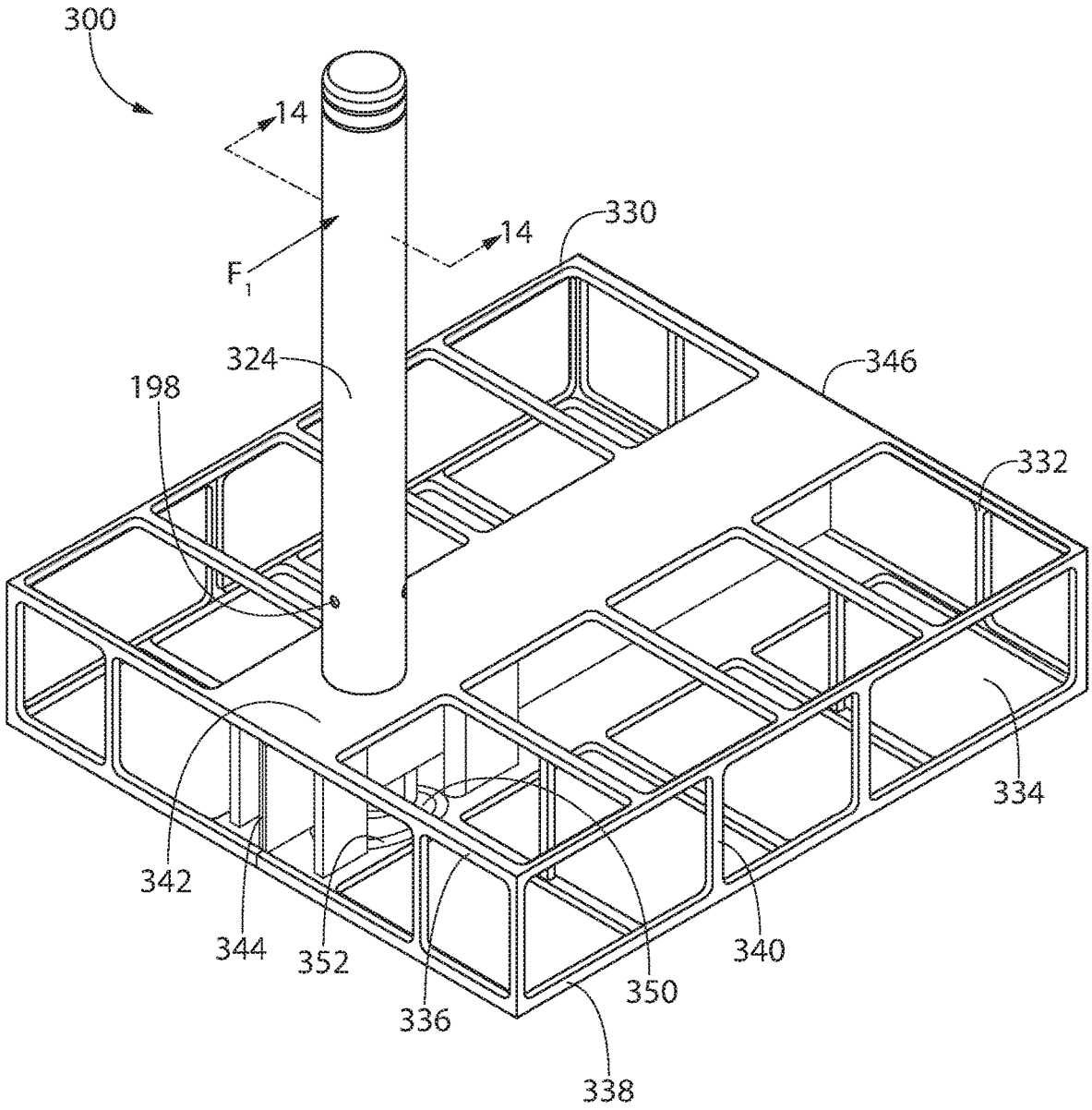
FIG. 11 is a perspective view of a barrier system in accordance with another exemplary embodiment of the present invention.
Figure 12:
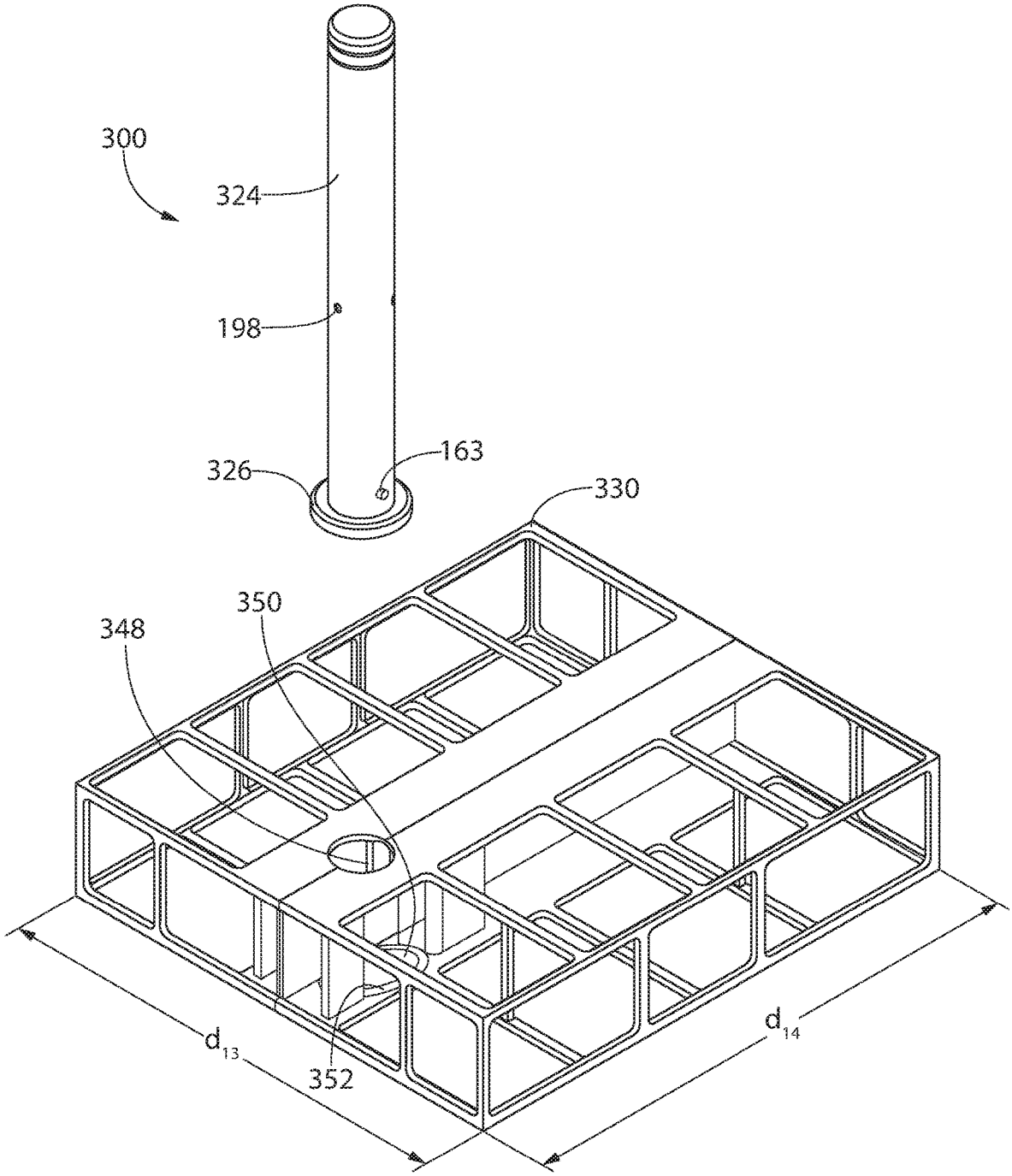
FIG. 12 is an exploded view of the barrier system of FIG. 11.

Referring to FIGS. 11-12, the foundation cage 330 may include an array 332 (e.g., a rectangular array) of cells 334. The cells 334 may be open cells 334. The cells 334 may be formed by an upper layer 336 and a bottom layer 338. At least one of the upper layer 336 and the bottom layer 338 may form a grid. In some embodiments, the upper layer 336 is a mirror of the bottom layer 338. In other embodiments, the upper layer 336 and the bottom layer 338 have different layouts. Posts 340 may couple to the upper layer 336 and the bottom layer 338.

Referring to FIGS. 11-14, the foundation cage 330 may include a beam 342 (e.g., an I-beam). The beam 342 may extend from a first lateral side 344 to a second lateral side 346 of the rectangular array 332. The first side 344 may be opposite the second side 346. The beam 342 may extend from a top of the foundation cage 330 to a bottom of the foundation cage 300. The beam 342 may include a top opening 348 and a bottom opening 350 sized and shaped to receive post 320. The bottom opening 350 may include a ridge 352 (FIG. 14). The ridge 352 may support the end of the core 324. The ridge 352 may define a pocket configured to receive a flange 326 on the core 324. The core 324 may include a flange 326. The flange 326 may extend radially from the proximal end of the core 324. The flange 326 may contact the foundation cage 330 to prevent the core 324 from being pulled out of the foundation cage 330. The flange 326 may help maintain the alignment of the core 324 relative to the foundation cage 330. The fastener 163 may protrude from at least one side of the core 324 and be spaced from the flange 326 such that a portion of the ridge 352 is secured between the fastener 163 and the flange 326 when the core 324 is coupled to the foundation cage 330.

Referring to FIGS. 12 and 13, in some embodiments, top opening 348 and bottom opening 350 are formed at one end of the beam 342. In other embodiments, the top opening 348 and bottom opening 350 may be positioned at other positions (e.g., more central) along the length of the beam 342. The foundation cage 330 may be aligned such that the beam 342 is orientated in line with an expected direction of impact $F_1$ of a vehicle. The core 324 may extend from the foundation cage 330 proximate a front edge such that the foundation cage 330 extends from the core 324 in a direction toward the protected area.

The foundation cage 330 may be prefabricated. In some embodiments, the foundation cage 330 is fabricated by welding steel or iron pieces together. In other examples, the foundation cage 330 is formed as a single, integral part by casting iron or steel (e.g., using a sand casting procedure).

Referring to FIGS. 12 and 14, the foundation cage 330 may have a width $d_{13}$ of about 48 inches, about 44 inches, about 40 inches, about 36 inches, or about 32 inches, about 28 inches, about 24 inches, about 20 inches, or about 16 inches. The foundation cage 330 may have a length $d_{14}$ of about 60 inches, about 56 inches, about 52 inches, about 48 inches, about 44 inches, about 40 inches, about 36 inches, or about 32 inches, about 28 inches, about 24 inches, about 20 inches, or about 16 inches. The foundation cage 330 may have a height $d_{15}$ of about 12 inches, about 11 inches, about 10 inches, about 9 inches, about 8 inches, about 7 inches, about 6 inches, about 5 inches, or about 4 inches. The foundation cage 330 may be placed in a footing 312 with substrate 308 and the footing 312 may have a depth $d_{17}$ of about 14 inches, about 12 inches, about 10 inches, about 8 inches, or about 6 inches. The foundation cage 330 may be spaced from the bottom of the footing 312 by a distance $d_{16}$ of about 10 inches, about 9 inches, about 8 inches, about 7 inches, about 6 inches, about 5 inches, about 4 inches, about 3 inches, about 2 inches, or about 1 inch. The core 324 may extend above the ground surface 310 by a distance $d_{18}$ of about 48 inches, about 44 inches, about 40 inches, about 36 inches, or about 32 inches, about 28 inches, about 24 inches, about 20 inches, or about 16 inches. The cover 122 may extend above the ground surface 310 by a distance $d_{19}$ of about 48 inches, about 44 inches, about 40 inches, about 36 inches, or about 32 inches, about 28 inches, about 24 inches, about 20 inches, or about 16 inches.

Referring to FIGS. 12 and 14, it may be desirable to install the barrier system 300 perpendicular to the ground surface 310. The foundation cage 330 may be configured to adjust the orientation of the upper layer 336 relative to the ground surface 310. The foundation cage 330 may include leveling feet (not shown). The leveling feet may be coupled to the bottom layer 338. The leveling feet may contact the bottom of the hole. The height of the leveling feet may be adjustable (e.g., via a threaded engagement) relative to the bottom layer 338. The core 324 may extend through the top opening 348 and the bottom opening 350 such that the orientation of the core 324 is fixed relative to the bottom layer 338. The leveling feet may adjust the orientation of the core 324 relative to the ground surface 310 as the leveling feet adjust the orientation of the bottom layer 338.

The barrier system 300 may be installed in a hole in the surface 114. The hole to install barrier system 300 may have a larger horizontal footprint than the hole required for barrier system 100. Referring to FIGS. 11-14, a method of installing barrier system 300 may include digging a hole that is appropriately sized and shaped to foundation cage 330. The method may include inserting the core 324 through the bottom opening 350 of the bottom layer 338 and up through the top opening 348 of the upper layer 336. In some embodiments, the substrate 308 is added prior to coupling the damper 126 and cover 122 to the core 324. In other embodiments, the damper 126 and the cover 122 are coupled to the core 324 before adding the substrate 308.

The method may include positioning the damper 126 and cover 122 over the core 324 so that the holes 198 in each of the cover 122, damper 126, and core 324 are aligned. A fastener may be inserted through the holes 198 to secure the cover 122 and the damper 126 to the core 324. The fastener 163 may be inserted through the hole 197 at the lower end of the core 124, to secure the post 320 to the beam 342 of foundation cage 330. Post 320 and foundation cage 330 may be placed within the hole so that the elongate cover 122 is exposed above the surface of ground. The foundation cage 330 may be positioned such that the beam 342 is aligned with an expected direction of impact. The levelling feet may be adjusted such to achieve a desired orientation of the post 320 relative to the ground surface. The substrate 308 (e.g., concrete) may be poured into the hole to secure the entire barrier system 300 into the ground.

It will be appreciated by those skilled in the art that changes could be made to the exemplary embodiments shown and described above without departing from the broad inventive concepts thereof. It is understood, therefore, that this invention is not limited to the exemplary embodiments shown and described, but it is intended to cover modifications within the spirit and scope of the present invention as defined by the claims. For example, specific features of the exemplary embodiments may or may not be part of the claimed invention and various features of the disclosed embodiments may be combined. Unless specifically set forth herein, the terms "a", "an" and "the" are not limited to one element but instead should be read as meaning "at least one".

It is to be understood that at least some of the figures and descriptions of the invention have been simplified to focus on elements that are relevant for a clear understanding of the invention, while eliminating, for purposes of clarity, other elements that those of ordinary skill in the art will appreciate may also comprise a portion of the invention. However, because such elements are well known in the art, and because they do not necessarily facilitate a better understanding of the invention, a description of such elements is not provided herein.

Further, to the extent that the methods of the present invention do not rely on the particular order of steps set forth herein, the particular order of the steps should not be construed as limitation on the claims. Any claims directed to the methods of the present invention should not be limited to the performance of their steps in the order written, and one skilled in the art can readily appreciate that the steps may be varied and still remain within the spirit and scope of the present invention.

What is claimed is:

1. A bollard comprising:

an impact receiving post having an outer surface, a proximal end, and a distal end; and a foundation cage defining a three-dimensional lattice structure, the foundation cage coupled to the proximal end of the impact receiving post and configured for installation in concrete beneath a ground surface, the foundation cage defining a recess that receives a proximal portion of the impact receiving post, the foundation cage including a first horizontal stop member fixed to the foundation cage beneath the impact receiving post at a predetermined position before inserting the foundation cage in the ground surface and a second horizontal stop member fixed to the foundation cage beneath the impact receiving post at the predetermined position before inserting the foundation cage in the ground surface, the first and second horizontal stop members forming at least one opening, the first and second horizontal stop members at least partially extending across the recess and supporting the impact receiving post and preventing the impact receiving post from extending further into the foundation cage, wherein a maximum length of the horizontal stop member is approximately equal to an outermost width of the foundation cage, and wherein the foundation cage is cylindrical and has an inner diameter approximately equal to an outer diameter of the impact receiving post.

2. The bollard of claim 1, wherein the foundation cage includes a plurality of upright members spaced from each other and aligned with the impact receiving post substantially vertically when installed beneath the ground surface.

3. The bollard of claim 2, wherein the foundation cage includes a plurality of horizontal members with each of the plurality of horizontal members coupled to at least two upright members of the plurality of upright members, wherein each of the plurality of horizontal members includes a first end and a second end with the first end overlapping the second end.

4. The bollard of claim 3, wherein the plurality of horizontal members extend circumferentially around the plurality of upright members, the plurality of horizontal members defining an outer perimeter of the foundation cage.

5. The bollard of claim 3, wherein the plurality of upright members extend distally beyond a distal-most horizontal member of the plurality of horizontal members.

6. The bollard of claim 3, wherein the plurality of upright members extend proximally beyond a proximal-most horizontal member of the plurality of horizontal members.

7. The bollard of claim 3, wherein the plurality of horizontal members are perpendicular to the upright members.

8. The bollard of claim 2, wherein the plurality of upright members are parallel to each other.

9. The bollard of claim 1 further comprising:

a cover that extends over the distal end and a distal portion of the outer surface of the impact receiving post; and a damper sandwiched between the cover and the impact receiving post, the damper comprised of an elastomeric material.

10. The bollard of claim 9, wherein the impact receiving post includes a post height as measured from the proximal end to the distal end, and wherein the damper includes a damper proximal end, a damper distal end, and a damper height as measured from the damper proximal end to the damper distal end, the damper height being approximately 40 percent to approximately 60 percent of the post height.

11. The bollard of claim 1, wherein the foundation cage is comprised of rebar.

12. The bollard of claim 1, wherein the distal end of the impact receiving post is unsupported and configured to deflect relative to the proximal end of the impact receiving post and the bollard is a single, standalone bollard that complies with ASTM F3016 when the foundation cage and at least a portion of the impact receiving post are installed in concrete beneath the ground surface.

13. The bollard of claim 1, wherein the foundation cage includes a cage proximal end, a cage distal end, a cage height as measured from the cage proximal end to the cage distal end, and an overlapping portion that overlaps a portion of the impact receiving post, the overlapping portion comprising approximately 40 percent to approximately 60 percent of the cage height.

14. The bollard of claim 1, wherein the impact receiving post has a diameter of approximately 5 inches to approximately 6 inches.

15. The bollard of claim 1, wherein the impact receiving post has a height extending from the foundation cage of at least approximately 30 inches.

16. The bollard of claim 1, wherein the impact receiving post has a diameter of approximately 5 inches to approximately 6 inches and a height extending from the foundation cage approximately 30 inches to approximately 54 inches.

17. The bollard of claim 13, wherein the overlapping portion overlaps the impact receiving post by at least 21 inches.

18. The bollard of claim 1, wherein the foundation cage has a diameter of approximately 9 inches.

19. The bollard of claim 1, wherein the foundation cage has a height of approximately 36 inches and a diameter of approximately 9 inches.

20. The bollard of claim 1, wherein the foundation cage and the impact receiving post are configured to limit a displacement of the distal end of the impact receiving post to 48 inches or less when the bollard is struck by a vehicle weighing up to 5,000 pounds and traveling at up to 10 mph when the foundation cage and at least a portion of the impact receiving post are installed in concrete beneath the ground surface.

21. The bollard of claim 1, wherein at least a portion of the impact receiving post is hollow.

22. The bollard of claim 1, wherein the foundation cage only partially overlaps the impact receiving post.

23. The bollard of claim 1, wherein the impact receiving post is cylindrical and includes a constant diameter from the proximal end to the distal end.

24. The bollard of claim 1, wherein the second horizontal stop member is parallel to the first horizontal stop member.

25. A bollard comprising:

an impact receiving post having an outer surface, a proximal end and a distal end, the impact receiving post being cylindrical and having a constant diameter from the proximal end to the distal end, at least a portion of the impact receiving post being hollow; and a foundation cage comprised of rebar and defining a three-dimensional cylindrical lattice structure coupled to the proximal end of the impact receiving post, the foundation cage defining a recess to receive the proximal end of the impact receiving post such that the foundation cage partially overlaps the impact receiving post, the foundation cage configured for installation in a concrete core having a diameter of approximately 8 inches to approximately 16 inches beneath a ground surface, the foundation cage having a height of approximately 30 inches to approximately 42 inches and a diameter of approximately 8 inches to approximately 10 inches, the foundation cage including:

a plurality of upright members spaced from each other and parallel to each other, the plurality of upright members aligned substantially vertically when installed beneath the ground surface;

a plurality of horizontal members each coupled to at least two upright members of the plurality of upright members, the plurality of horizontal members extending circumferentially around the plurality of upright members and each including a first end and a second end with the first end overlapping the second end, the plurality of upright members extending distally beyond a distal-most horizontal member of the plurality of horizontal members and proximally beyond a proximal-most horizontal member of the plurality of horizontal members, the plurality of horizontal members being perpendicular to the plurality of upright members; and a first horizontal stop member and a second horizontal stop member parallel to the first horizontal stop member, each of the first horizontal stop member and second horizontal stop member fixed to the foundation cage beneath the impact receiving post at a predetermined position before inserting the foundation cage in the ground surface, the first and second horizontal stop members extending across the recess to support the impact receiving post and preventing the impact receiving post from extending further into the foundation cage, wherein the distal end of the impact receiving post is unsupported and configured to deflect relative to the proximal end of the impact receiving post and the bollard is a single, standalone bollard that complies with ASTM F3016 when the foundation cage and at least a portion of the impact receiving post are installed in concrete beneath the ground surface.

26. The bollard of claim 1, wherein the first and second horizontal stop members are comprised of rebar.

27. The bollard of claim 1, wherein the first and second horizontal stop members are positioned between a proximal end of the foundation cage and a distal end of the foundation cage.

28. The bollard of claim 1, wherein the first and second horizontal stop members have a diameter of about 0.5 inches.

29. The bollard of claim 1, wherein the foundation cage includes a plurality of upright members and the first and second horizontal stop members are fixed to at least one of the plurality of upright members.

30. The bollard of claim 1, wherein the foundation cage is configured to support the impact receiving post in generally the final position under the ground surface before adding concrete.

* * * * *